United States Patent [19]

Hofer

[11] Patent Number: 4,949,806

[45] Date of Patent: Aug. 21, 1990

[54] HEADSET FOR UNDERWATER USE

[75] Inventor: Alan Hofer, Wantagh, N.Y.

[73] Assignee: Stanton Magnetics, Inc., Plainview, N.Y.

[21] Appl. No.: 287,490

[22] Filed: Dec. 20, 1988

[51] Int. Cl.[5] ..... H04R 25/00

[52] U.S. Cl. ..... 181/129; 181/149; 181/171; 181/174; 381/159; 381/169; 381/183; 381/189; 381/205

[58] Field of Search ..... 181/129, 130, 148, 149, 181/173, 174; 381/158, 162, 163, 169, 183, 187–189, 159, 205

[56] References Cited

U.S. PATENT DOCUMENTS

| | | | |
|---|---|---|---|
| 2,293,078 | 8/1942 | Proctor | 381/189 X |
| 2,989,598 | 6/1961 | Tougau et al. | 381/158 X |
| 3,733,445 | 5/1973 | Sebester et al. | 381/200 |
| 4,456,797 | 6/1984 | Olsen | 381/25 X |
| 4,565,258 | 1/1986 | Butler et al. | 181/129 X |
| 4,682,363 | 7/1987 | Goldfarb et al. | 381/189 X |
| 4,843,628 | 6/1989 | Hojer | 381/200 |

*Primary Examiner*—B. R. Fuller

*Attorney, Agent, or Firm*—Kane, Dalsimer, Sullivan, Kurucz, Levy, Eisele and Richard

[57] ABSTRACT

A headset is provided which includes an inverted cup-shaped housing. The housing contains a rigid membrane which separates the housing into an upper chamber and a lower chamber. An inertial transducer is positioned in the upper chamber secured to the membrane. Electrical leads extend into the transducer through water tight connections. A headband is provided to secure the headset to a listener's ear and a cushion is provided about the open bottom end of the headset housing. Only the transducer itself is water tight. Both the upper and lower chambers of the housing freely permit the passage of water.

6 Claims, 2 Drawing Sheets

HEADSET FOR UNDERWATER USE

BACKGROUND OF THE INVENTION

The present invention relates to headsets and in particular to a headset designed for underwater applications.

The conventional headset utilizes a speaker in which a electric current serves to disturb an electro-magnetic field to, in turn, drive a diaphragm to move the air in front of the diaphragm and thereby generate sound waves.

It has heretofore been proposed to provide a headset which may be used for commercial, recreational or military purposes in a water environment. Such headsets have, by and large been water resistant in that they are capable of being wetted as distinct from actually operating underwater. The reason for this is that such headsets operated on the same principal as conventional headsets, modified only in that the driver was surrounded by a water tight cup which serves to seal the ear of the user. The air captured within the cup was driven in the same manner as conventional headset speakers to produce the desired sound waves heard by the listener. The obvious drawback with such devices is that their operation relies entirely upon the seal about the listener's ear and should that seal be disturbed water would flow into the cup causing the effectiveness of the speaker to be almost entirely lost.

In addition to the conventional diaphragm-type speaker discussed above, there is a type of speaker which utilizes as its driver an inertial transducer. Such speakers are mainly used in bone conduction speakers. In an inertial transducer the vibrations of a sound source are applied to a relatively small mass connected to a relatively large mass through a spring diaphragm. The movement of the small mass with respect to the large mass causes the spring diaphragm to oscillate within an electro-magnetic field thereby generating an electric output signal. When the transducer is operating as a speaker the electric signal is used to vary the electromagnetic field to thereby drive the spring diaphragm connecting the large mass to the small mass and thereby causing the small mass to vibrate with respect to the large mass to produce sound waves. The entire transducer may be kept within a housing so that sound may be transmitted by simply placing the housing against the skull or other appropriate bone of the listener. While a sufficiently packaged inertial speaker should operate as a bone conduction device in an underwater environment, a problem arises in maintaining the transducer in position particularly on an active person such as one surfing, water skiing or the like. In addition, inertial transducer generally have a rather "tinny" sound due to the fact that the spring diaphragm is basically a single frequency device.

In view of the above it is the principal object of the present invention to provide a headset capable of operating both in air and underwater.

A further object is to provide such a device which is comfortable for the user and which may readily be applied and removed.

A still further object is to provide such a device in a form that is relatively simple and inexpensive to manufacture and assemble.

Still other objects and advantages will become apparent from a review of the following description of the present invention.

SUMMARY OF THE INVENTION

The above and other beneficial objects and advantages are attained in accordance with the present invention by providing a headset which includes an inverted cup-shaped housing. The housing contains a rigid membrane which separates the housing into an upper chamber and a lower chamber. An inertial transducer is positioned in the upper chamber secured to the center of the membrane. The membrane has a variable thickness with its thickest portion at the center and gradually tapering down to the periphery. Electrical leads extend into the transducer through water tight connections. A headband is provided to secure the headset to a listener's ear and a cushion is provided about the open bottom end of the headset housing. Only the transducer itself is water tight. Both the upper and lower chambers of the housing freely permit the passage of water and the cushion is provided only for the comfort of the user and provides no sealing function.

DETAILED DESCRIPTION OF THE PREFERRED EMBODIMENT

Figure 1:
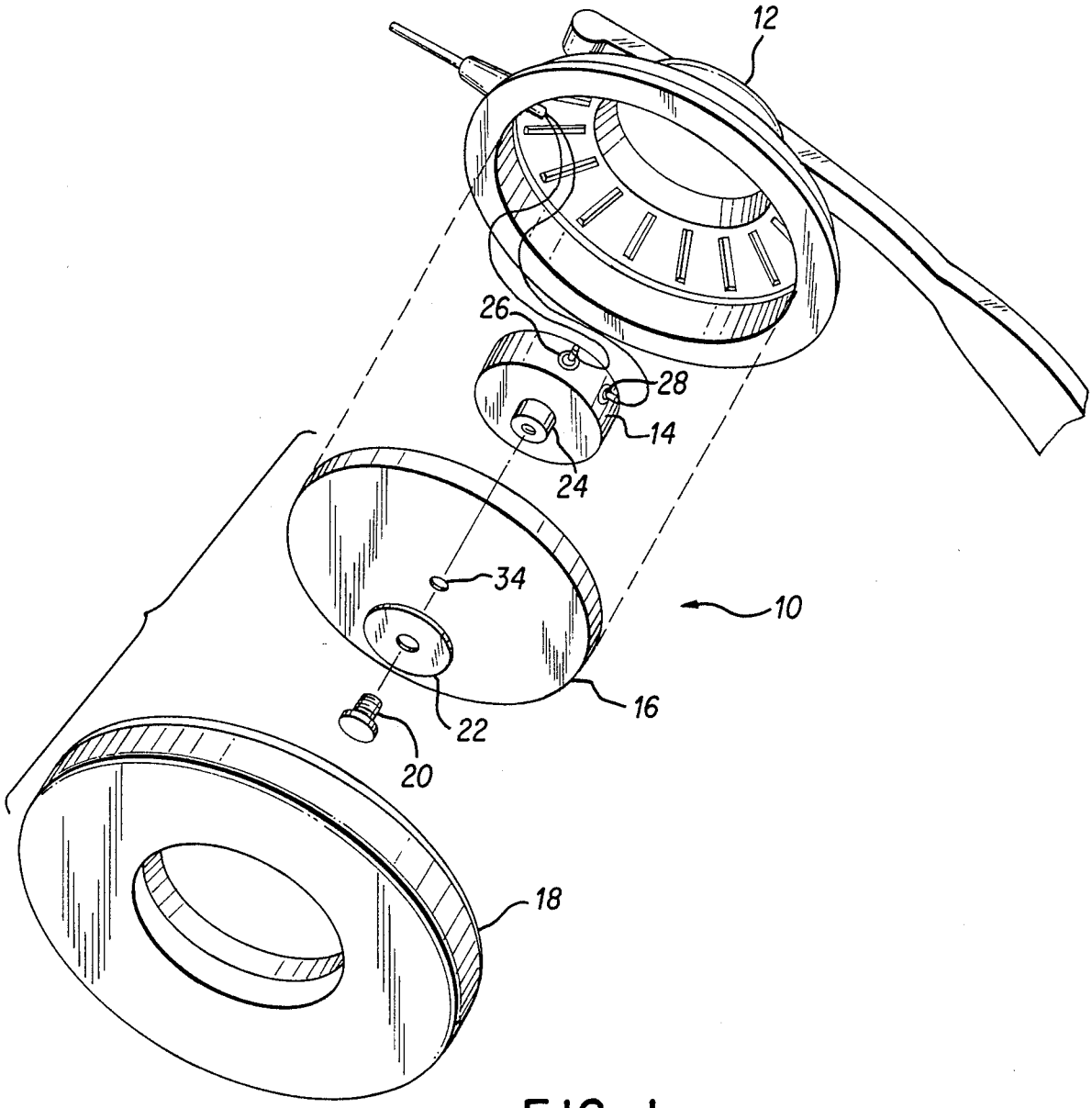
FIG. 1 is an exploded perspective view of the underwater headset of the present invention.
Figure 2:
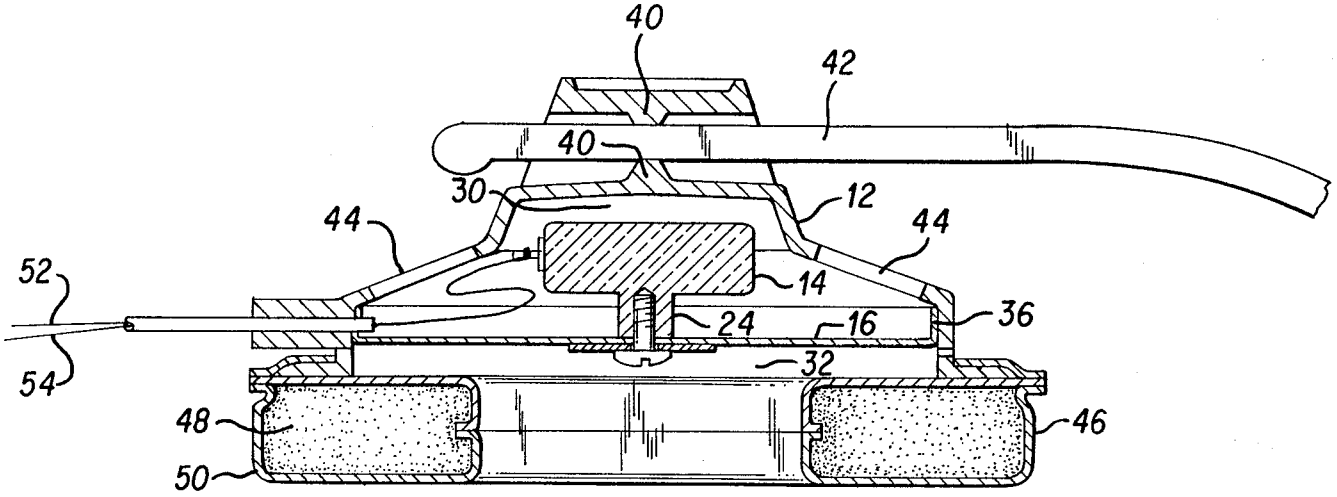
FIG. 2 is a fragmentary side elevational sectional view of the assembled headset; and, FIG. 3 is a side elevational sectional view of the transducer-membrane assembly of the present headset.
Figure 3:
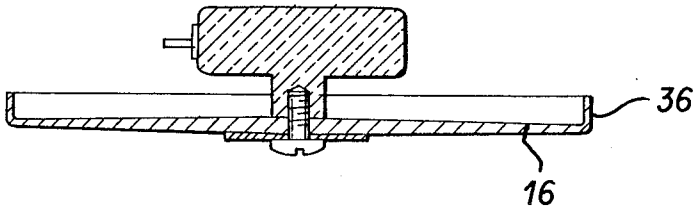

Reference is now made to the drawings and to FIG. 1 in particular wherein a headset 10 in accordance with the present invention is shown comprising a housing 12, transducer 14, membrane 16 and cushion ring 18. While only a single speaker is shown it should be apparent that the headset may comprise a pair of speakers so as to give a stereophonic effect to the listener. The transducer 14 is an inertial transducer and may, for example be of the type disclosed in detail in my co-pending application Ser. No. 883,985 filed Jul 10, 1986 for INERTIAL MICROPHONE/RECEIVER WITH EXTENDED FREQUENCY RESPONSE.

What is important to note is that all of the components of transducer 14 are packaged within a sealed can or housing. The transducer is thus a sealed unit the effectiveness of the seal being the only limitation on the depth to which the present headset may be used. The transducer 14 is secured to a rigid membrane 16 Via screw 20 and washer 22 which engage a threaded bushing 24 extending from the transducer housing 12. It should be noted that the threaded bushing 24 preferably does not extend into the interior of the transducer housing 12 thereby avoiding this connection as a possible source of water leakage into the transducer. The transducer is driven via a pair of electrical leads 26, 28 which extend into the transducer housing 12 and are carefully potted so as to render the openings for the leads watertight.

The membrane 16 as well as the headset housing are formed of suitable plastic materials inert to salt water. The membrane 16 is generally disc-shaped and must be formed of a relatively rigid material, such as acrylic to enable it to vibrate in response to oscillations of the transducer diaphragm. It should be noted that the membrane 16 has a variable thickness. The thickest portion of the membrane is at the center and the thickness gradually reduces to the periphery. It has been found that this membrane configuration widens the frequency response of the transducer. In this regard, the thickness of washer 22 is also somewhat critical in that it serves to further extend the high frequency response of the transducer.

The membrane 16 is secure about its periphery to the interior of the housing 12 separating the housing into an upper chamber 30 and lower chamber 32. As noted above the transducer 14 is positioned in the upper chamber 30. The membrane 16 is provided with a central opening 34 to accommodate screw 20. An upwardly directed lip 36 extends about the periphery of membrane 16 to engage the interior of the housing 12. The membrane 16 is held in position with a suitable adhesive.

The top 38 of the housing 12 is provided with a pair of spaced detents 40 which cooperate to form a friction engagement with a headband 42 thereby rendering the position of the housing 12 adjustable with respect to the headband. The top of the housing 12 is provided with a series of slots 42 through which water can freely flow into and out of the upper chamber.

A cushion ring 18 extends about the open bottom end of the housing. The cushion comprises a foam material 48 encased within a suitable outer casing 50. It should be noted that the cushion serves only as a comfortable interface with the listener's ear and does not attempt to keep water out of the lower chamber.

In operation a signal transmitted along leads 52, 54 to terminals 26, 28 serves to activate the inertial transducer. The vibrations of the transducer are translated to membrane 16 which, in turn, pushes the fluid in front of it toward and away from the ear of the listener in response to the transmitted signal. The fluid medium may be either air, water or a combination of air and water. It should be further noted that the medium (i.e. air or water) flows freely on both sides of membrane 16 and that no attempt is made to seal the headset to the listener's ear. The depth of water to which the headset may be operated is limited only by the effectiveness of the seal and wall thickness of the transducer but is not limited by the construction of the headset.

Thus, in accordance with the above the aforementioned objects are effectively attained.

What is claimed is:

1. An underwater headset speaker comprising;

a housing having an unsealed interior portion and an open bottom end, a rigid membrane positioned within said housing separating said housing into an upper chamber and a lower chamber, said membrane having a periphery secured to said housing interior portion; and, an inertial transducer packaged within a water tight casing positioned in said upper chamber and secured to said membrane whereby said membrane vibrates in response to excitation of said transducer.

2. The headset in accordance with claim 1 wherein said membrane comprises a rigid disc having a center and said transducer is centrally secured to the center of said membrane.

3. The headset in accordance with claim 1 further comprising a cushion ring disposed about said housing open end.

4. The headset in accordance with claim 1 further comprising a plurality of openings in said housing extending into said upper chamber.

5. The headset in accordance with claim 1 wherein said membrane has a variable thickness.

6. The headset in accordance with claim 5 wherein said membrane has a center and the thickness of the membrane is greatest at said center and least about said periphery.

* * * * *